United States Patent [19]

Johnston

[11] 4,150,668

[45] Apr. 24, 1979

[54] MASSAGE DEVICE

[76] Inventor: Lyman C. Johnston, 12 Boulton Dr., Toronto, Canada

[21] Appl. No.: 904,469

[22] Filed: May 10, 1978

Related U.S. Application Data

[60] Continuation of Ser. No. 744,383, Nov. 23, 1976, abandoned.

[30] Foreign Application Priority Data

Jun. 8, 1976 [CA] Canada ..... 254654

[51] Int. Cl.[2] ..... A61H 7/00

[52] U.S. Cl. ..... 128/49

[58] Field of Search ..... 128/41–49, 128/24.1, 24.2, 24.5

[56] References Cited

U.S. PATENT DOCUMENTS

| | | | |
|---|---|---|---|
| 1,592,144 | 7/1926 | Macaura | 128/24.5 |
| 2,964,037 | 12/1960 | Johnston | 128/49 |

FOREIGN PATENT DOCUMENTS

| | | | |
|---|---|---|---|
| 67266 | 1/1944 | Norway | 128/49 |

*Primary Examiner*—Lawrence W. Trapp

*Attorney, Agent, or Firm*—William T. Howell

[57] ABSTRACT

A massage device has a rocking member, a synchronous electric motor drive, an elastomeric pivot, a drive connecting member, a rigid structure supporting said pivot and massage elements on the rocking member which move in opposite direction during the rocking motion. Gripping means are secured to the rigid structure, at a location of minimum motion of the rigid structure to minimize the vibration transmitted to the operator; preferably the gripping means are resiliently secured to the rigid structure. The device is weighted so that the moment of force about the elastomeric pivot is sufficient to cause slowing of the motor when the massage members act on the body and increased pressure on the gripping means lowers the frequency of the massage elements. A weight, adjustable in position with respect to the elastomeric pivot, is located on the rigid structure in opposed relation to the drive connecting member; movement of the weight causes change in the amplitude of the massage elements.

11 Claims, 4 Drawing Figures

MASSAGE DEVICE

This is a continuation, division, of abandoned application Ser. No. 744,383 filed 11/23/76.

This invention relates to a massage device.

Prior Art

In U.S. Pat. No. 2,964,037 a massage device is described which comprises a rocking member, drive means, an elastomeric pivot, a drive connecting member, a structure supporting said pivot and massage elements which are adjustable in position with respect to the pivot, thereby varying the amplitude of the massage elements. The adjustment is effected by mounting each massage element on a shaft having a gear which meshes with a rack member mounted on the rocking member, the amplitude of the massage element being varied by turning. However, this involves temporary discontinuance of operation of the massage device; furthermore deep muscle massage obtained by giving the massage elements a stroke of up to 1" cannot be achieved because the vibration transmitted to the operator is too great. Also the massage device described in the above specified U.S. Patent operates at a fixed frequency depending on the selection of the drive means.

SUMMARY OF THE INVENTION

It is an object of the invention to provide a massage device of the type described above which has means for changing the amplitude or stroke of the massage elements during operation.

It is a further object of the invention to provide a massage device wherein the frequency of the massage elements, initially dictated by the electrical drive means, may be changed instantly during operation.

It is a further object of the invention to provide a massage device wherein the massage elements may operate at either a higher or lower frequency level simply by manipulation of the operator.

It is a further object of the invention to provide a massage device of the type described wherein the massage elements operate either at a higher frequency e.g. of about 20 to 24 cycles per second which corresponds to the frequency of the so called $\beta$ waves emanated by the brain during the active state ocata lower frequency e.g. of between 10 to 12 cycles per second corresponding to the so called $\alpha$ waves emanated by the brain during the passive or relaxed state.

To provide the change in frequency, the massage device has gripping means which is secured thereto at the location of minimum motion of the supporting structure; preferably the gripping means are secured to the supporting structure. This minimises the vibration transmitted to the operator and enables a stroke of up to 1" on the massage element to be delivered to the body tissue. Preferably the location of the gripping means is above the elastomeric pivot.

It is an additional feature of the device that the drive means is a synchronous motor with sufficient weight in the supporting structure so that while one level of pressure on the gripping means will cause the massage members to operate down to about 22 cycles per seond, additional pressure on the gripping means will cause the massage members to operate down to about 10 cycles per second. The weight of the supporting structure is distributed so that, when held by the gripping means, the moment of force about the elastomeric pivot is sufficient to cause slowing of the motor when the massage members are on body tissue.

The change in amplitude of the massage elements is provided by adding weight to the structure supporting the pivot, at a position opposed to the drive connecting member, which weight has means to move it towards and away from the pivot.

A further feature of the device is that the massage elements are constructed in such a manner that they may be covered by a removable plastic film which may be disposed of and quickly replaced.

DESCRIPTION OF A PREFERRED EMBODIMENT

In the description like numbers represent like parts.

Figure 1:
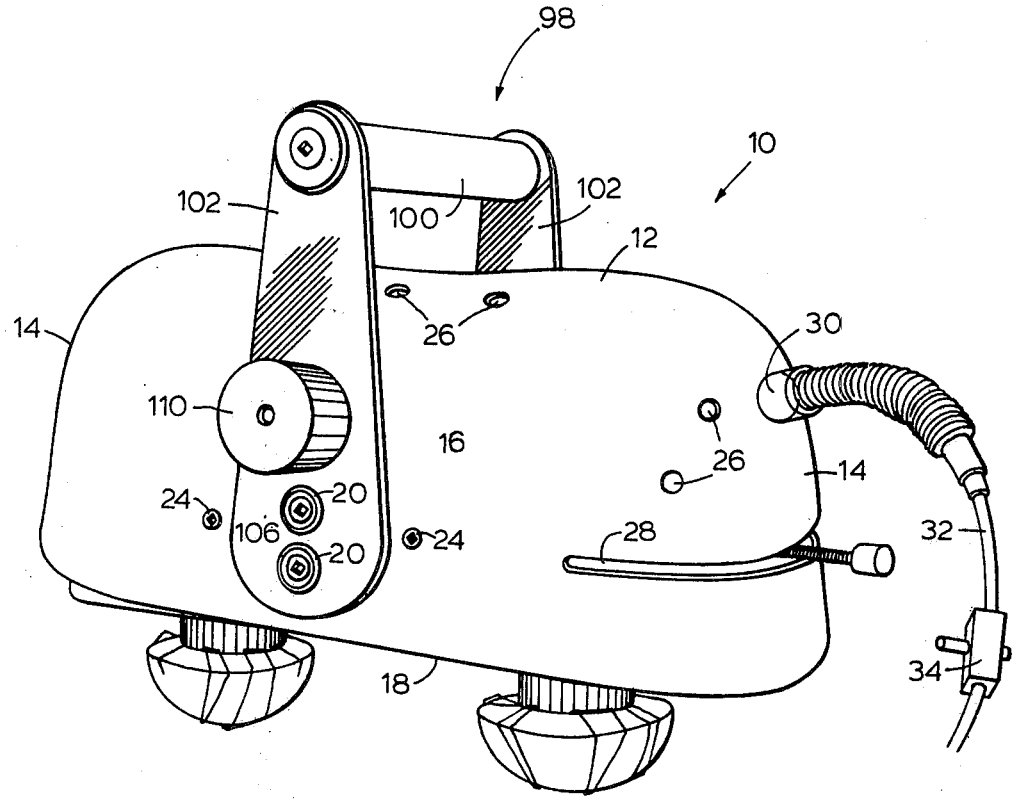
FIG. 1 is a view in perspective of the massage device.
Figure 2:
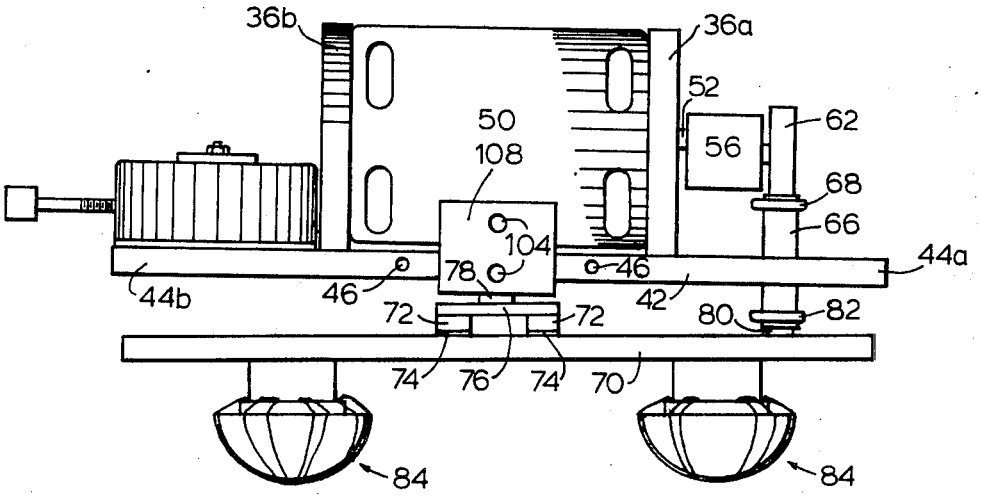
FIG. 2 is a side elevational view of the device with the cover removed.
Figure 3:
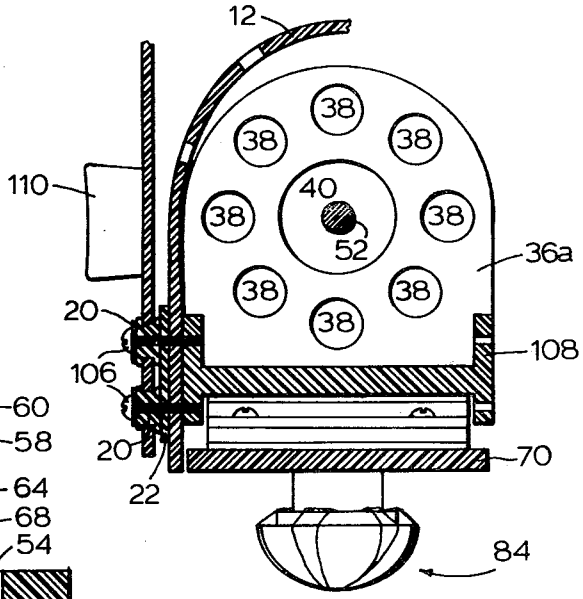
FIG. 3 is a sectional view in elevation of the device.

With reference to FIG. 1 the massage device has an elongated casing, generally denoted by the numeral 10 and preferably made of plastic. The casing 10 has a rounded top 12 which curves integrally into rounded end walls 14 and substantially parallel side walls 16 to define an opening 18. Centrally located on the outside of each side wall 16 are a pair of vertically disposed hollow rubber bushings 20. Each side wall 16 has a pair of apertures, one to each side of the hollow rubber bushings 20, which apertures provide for securement by screws 24 of a rigid inner structure to be described later.

The casing 10 has a number of spaced apart apertures 26 located in the top 12 and the end walls 14; these apertures 26 provide for air circulation to connect heat away from the device when operating. A horizontally disposed slot 28 is located in one end wall 14 for a purpose to be described later. The casing 10 also has an opening 30 to permit entry of an electrical lead 32 which carries a conventional switch 34.

The rigid inner structure referred to above includes a pair of spaced apart vertically disposed plates **36*a* and 36*b* preferably made of plastic with each having a ring of apertures 38 which surround the central aperture 40. The plates 36*a* and 36*b* are secured normally to a horizontally disposed plate 42 short of the ends thereof, thus providing a pair of platforms 44*a* and 44*b*. The plate 42 is shaped to correspond with the opening 18 i.e. it has substantially parallel sides and rounded ends and the dimension of the plate 42 is such that it slides into the casing 10. The plate 42 has threaded holes 46 on its sides which provide for its securement to the casing 10 by means of screws 24** traversing the casing apertures.

The rigid structure formed of the plates **36*a* and 36*b* and 42 when secured in the casing 10 supports an electric motor, not shown in detail, generally denoted by the numeral 50 and having a protruding shaft 52. The motor 50 is secured to the plates 36*a* and 36*b* in such a manner that the shaft 44 extends through the central aperture 40 of the plate 36*a*. The ring of apertures 38 in each plate 36*a* and 36*b*** provide for cooling.

Platform **44*a* of the plate 42 has a slot 54. The motor shaft 52 extends over the platform 44*a* to carry a circular sleeve 56 eccentrically secured thereto. A rod 58 centrally secured to the sleeve 56 extends over the slot 54. The rod 58 carries a bearing 60 which supports another sleeve 62 which has an integral stub arm 64 extending downwards towards the slot 54. A tubular flexible coupling 66 is secured to the stub arm 64 by means of a clip 68. The flexible coupling 66 extends through the slot 54**.

Below the plate 42 and having a similar configuration is a rocker plate 70 which closes the opening 18 of the casing 10. The rocker plate 70 is mounted flexibly for pivotal movement on the transverse axis of the plate 42. The mounting comprises a pair of spaced apart transverse bars 72 secured to the top side of the rocker plate 70 each secured thereto through an intermediate fibre washer 74. The transverse bars 72 are joined at their upper surfaces by an elastomeric plate member 76. The lower side of the plate 42 has a centrally located transverse bar 78 which provides the pivotal axis for the rocker plate 70. The transverse bar 78 is secured on its underside to the mid portion of the elastomeric plate member 76, i.e. between the transverse bars 72.

The rocker plate 70 has an integral arm 80 on its upper side in line with the flexible coupling 66 and is secured thereto by a clip 82.

It will be apparent that when the motor 50 is switched on, the motor shaft 52, through the eccentrically located sleeve 56 and connected flexible coupling 66, will oscillate the rocker plate 70 about the transverse bar 78. Also the elastomeric plate member 76 provides for quiet operation.

A pair of massage elements each generally denoted by the numeral 84 extend from the underside of the rocker plate 70 outward of the casing 10. Each massage element 84 comprises a threaded rod 86 which may be located in a selected one of a series of correspondingly threaded holes 88 in the rocker plate 70. This provides for adjustment of the position and thereby the stroke of the massage elements 86.

In the massage elements 84 shown, the threaded rod 86 terminates in a mushroom shaped cap 90 covered by a rubber pad 92. It is a feature of the massage elements 84 that for hygenic purposes they are designed so that the rubber pad 92 may be covered by a disposable plastic cover 94. This is accomplished by means of a cup like member 96, the base of which is centrally threaded to secure it to the threaded rod 86. The plastic cover 94 is large enough not only to fit over the rubber pad 92 but to leave a perimeter which is caught in the rim of the cup like member 96 when the latter is screwed onto the threaded rod 86 against the mushroom shaped cap 90.

The casing 10 supports a carrying handle generally denoted by the numeral 98 which includes a circular cross bar 100 spaced from the casing 10 and opposed to the rocker plate 70. The cross bar 100 is secured to the corresponding ends of a pair of spaced apart plates 102, each having a pair of apertures 104 adjacent the other end. The hollow rubber bushings 20 provided on the side walls 16 fit into these apertures 104 and the handle 98 is secured to the rigid inner structure by means of screws 106 extending through the rubber bushings 20, the screws 106 terminating in vertical plates 108 carried by the plate 42.

Although the handle 98 is resiliently insulated from the rigid structure it is not intended to be held by the operator while the massage elements 84 are in contact with the body tissue because the oscillation of the handle 98 renders the hands insensitive.

It is a feature of the invention that the device may be used with practically no vibration being transmitted to the hands of the operator. This is accomplished by a circular abutment 110 on each plate 102, which circular abutments 110 constitutes separate holding means preferably resiliently insulated from the rigid structure of the device by the hollow rubber bushings 20 which, in turn, insulate the handle 98. The circular abutments 110 are preferably placed above the elastomeric plate member 76 but essentially at the location of minimum motion of the rigid structure when the device is operative.

The device is primarily intended for connection to the standard electrical supply and to facilitate its use therewith the motor 50 is of the synchronous type delivering about 1650 revolutions per minute. If the device is too light the massage elements 84 will bounce too much despite the application of pressure by the operator. On the other hand the device, to be portable and conducive to manipulation by the operator, must not be too heavy. Accordingly, the weight of the device is arranged so that the moment of force above the elastomeric pivot 76 is sufficient to cause slowing of the motor when the massage elements 84 act on the body tissue. This is arranged so that with the operator holding the device by the abutments 110 to apply minimum pressure the load causes the massage elements 84 to operate down to about a frequency of about 22 cycles per second. Motor characteristics and supply are variable but, by way of example and not by way of limitation, it has been found that with a four pole synchronous motor operating at about 1650 r.p.m. the weight of the device is between 6½ to 7½ lbs. The frequency of 22 cycles per second is desirable because it appears to have the maximum penetrative effect on the body tissue, otherwise known as deep muscle massage and because of the location of the abutments 110 a stroke of up to 1" of the massage elements 84 can be handled by the operator.

It has also been found that the position of the abutments 110 enables the operator to apply increased pressure which has the effect of lowering the frequency of the massage elements 84. In particular with the device weighted to operate at 22 cycles per second as described above, increasing pressure on the abutments 110 can be exerted to such a degree that the moment of force about the elastomeric pivot 76 will cause slowing of the motor 50 with the result that the massage elements 84 operate on body tissue down to about 12 cycles per second or lower e.g. 6 cycles per second depending on the nature of the body tissue.

It is often desirable to change the amplitude of the massage members instantly during deep muscle massage. This is achieved by including specific weight means, generally denoted by the numeral 112, in the rigid structure which is adjustable in position in relation to the elastomeric pivotal mounting 76 of the rocker plate 70. The weight 112 is located on the platform **44*b* thus being removed from the flexible coupling 66 with respect to the elastomeric plate member 76**.

Figure 4:
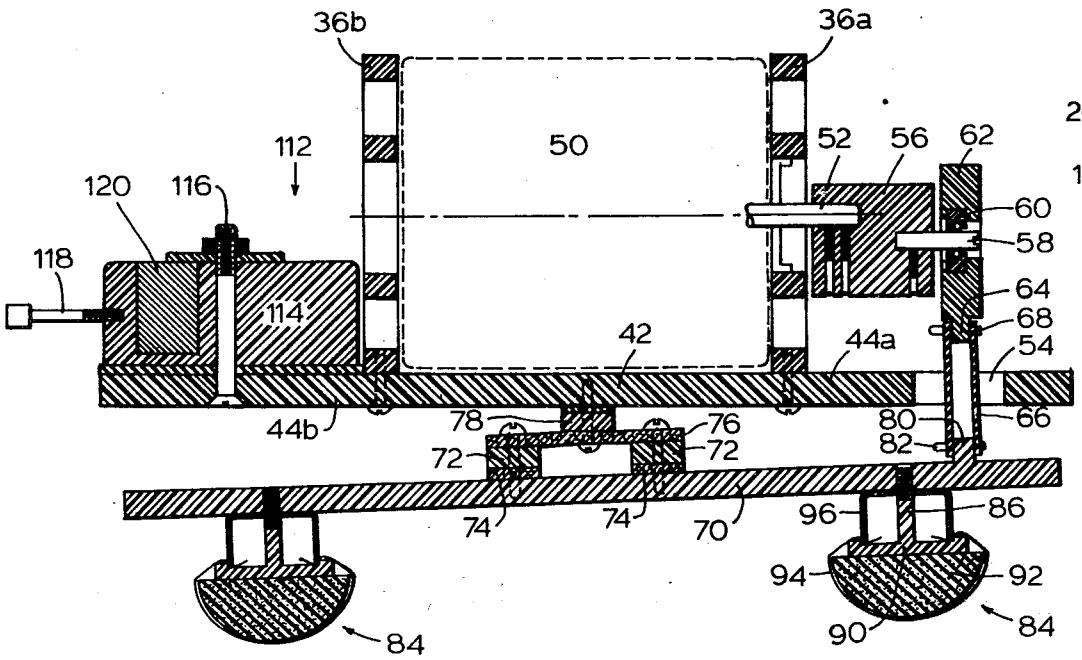
FIG. 4 is a part sectional view taken on the lines 4—4 of FIG. 2.

A particularly convenient form of adjustable weight means 112 is illustrated in FIG. 4 and comprises a circular block 114 rotatably mounted on a spindle 116 extending upwards from the platform **44*b*. The circular block 114 has an arm 118 projecting normally therefrom to extend outward through the slot 28 in the casing 10. The circular block 114 is eccentrically weighted by including in one position only a portion 120 of a heavier material e.g. the block 114 is made of plastic while the portion 120** is lead.

It will be apparent that movement of the arm 112 in the slot 28 will change the position of the portion 120 in relation to the pivotal mounting of the rocker plate 70 on the transverse bar 78. As the portion 120 is moved inward the amplitude of the massage elements 84 will diminish. When the massage elements 84 are placed against body tissue, the weight of the device is sufficient to provide a stroke of the elements of up to 1" when the device is held in position by the abutments 110. If the stroke is to be changed the position of the weighted portion of the circular block is then changed but otherwise the amplitude will be constant because the pressure is derived from the weight.

The location of minimum motion of the device can be determined by a strobescope. A fan may be mounted on the motor 50 to provide additional cooling of the device when operated for extended periods at the lower frequency of about 12 cycles per second.

I claim:

1. A massage device for manipulating body tissue comprising in combination a rigid structure, motor drive means on said structure, a rocking member having ends thereof, elastomeric means pivotally suspending said rocking member on said structure for rocking motion, reciprocating means actuable by said drive means attached to one of said ends to impart a rocking motion to said rocking member, massage elements on said rocking member located about said pivotally suspended elastomeric means, one of said elements being positioned thereon to move in a direction opposite to the direction of motion of another of said elements during rocking motion of said member and gripping means for holding said device secured to said rigid structure at the location of minimum motion of said rigid structure when said device is operative.

2. A massage device according to claim 1 wherein said drive means is a synchronous electric motor.

3. A massage device according to claim 2 wherein the weight of said rigid structure is distributed so that with pressure applied to said gripping means the moment of force about said elastomeric means is sufficient to cause slowing of said motor when said massage elements are on body tissue.

4. A massage device according to claim 2 wherein said synchronous motor drive means is adapted by weighting said rigid structure to cause said massage elements to operate on body tissue at a frequency of about 22 cycles per second when held by said gripping means and when additional pressure is applied thereto, said massage elements operate at about 12 cycles per second.

5. A massage device according to claim 1 wherein part of said rigid structure is a weight removed from said reciprocating means with respect to said elastomeric means, said weight being adjustable in position in relation to said elastomeric means to vary the amplitude of said massage elements during operation.

6. A massage device according to claim 5 wherein said weight is a circular block rotatably mounted on said rigid structure, said circular block being eccentrically weighted and means for rotating said circular block.

7. A massage device according to claim 6 wherein said means for rotating said circular block is an arm secured thereto and extending from said rigid structure.

8. A massage device according to claim 7 wherein said rigid structure supports a casing, a slot in said casing, said arm extending through said slot and moveable therein.

9. A massage device according to claim 1 wherein said massage elements each have a removable plastic cover.

10. A massage device according to claim 1 wherein said gripping means are a pair of opposed abutments on said rigid structure located on a transverse axis normal to said elastomeric pivot, said axis being equidistant from said ends.

11. A massage device according to claim 1 wherein said gripping means are resiliently secured to said rigid structure.

* * * * *